US007482982B2

(12) United States Patent
Jenwatanavet et al.

(10) Patent No.: US 7,482,982 B2
(45) Date of Patent: Jan. 27, 2009

(54) MULTIPART CASE WIRELESS COMMUNICATIONS DEVICE WITH MULTIPLE GROUNDPLANE CONNECTORS

(75) Inventors: Jatupum Jenwatanavet, San Diego, CA (US); Gregory Poilasne, San Diego, CA (US); Jorge Fabrega-Sanchez, San Diego, CA (US); Vaneet Pathak, San Diego, CA (US); Joe Le, Poway, CA (US)

(73) Assignee: Kyocera Wireless Corp., San Diego, CA (US)

( * ) Notice: Subject to any disclaimer, the term of this patent is extended or adjusted under 35 U.S.C. 154(b) by 378 days.

(21) Appl. No.: 11/357,647

(22) Filed: Feb. 16, 2006

(65) Prior Publication Data

US 2007/0120748 A1 May 31, 2007

Related U.S. Application Data

(63) Continuation-in-part of application No. 10/965,169, filed on Oct. 13, 2004, now Pat. No. 7,012,571, and a continuation-in-part of application No. 11/215,211, filed on Aug. 29, 2005.

(51) Int. Cl.
*H01Q 1/24* (2006.01)

(52) U.S. Cl. ..... 343/702; 343/700 MS

(58) Field of Classification Search ..... 343/702, 343/700 MS, 846, 848
See application file for complete search history.

(56) References Cited

U.S. PATENT DOCUMENTS 6,342,859 B1 1/2002 Kurz et al.
2002/0180651 A1 12/2002 Hareyama
2004/0027298 A1 2/2004 Iguchi et al.
2004/0201523 A1 10/2004 Yuanzhu
2004/0204006 A1 10/2004 Zhou et al.
2007/0052596 A1* 3/2007 Liu et al. ..... 343/702
2007/0159401 A1* 7/2007 Baliarda et al. ..... 343/702
2007/0164913 A1* 7/2007 Sakamoto et al. ..... 343/702
2007/0229373 A1* 10/2007 Mashima et al. ..... 343/702

FOREIGN PATENT DOCUMENTS

EP 1 170 817 A1 1/2002
EP 1 309 156 A1 5/2003
GB 2 229 322 A 9/1990

OTHER PUBLICATIONS

Cummings, Nathan P., "Low Profile Integrated GPS and Cellular Antenna", M.S. Thesis at Virginia Polytechnic Inst. & State Univ., Blacksburg, VA, pp. ii-viii & 1-80, Oct. 31, 2001.

* cited by examiner

*Primary Examiner*—HoangAnh T Le

(57) ABSTRACT

A wireless communication device is provided with a multipart case, having electrical interfaces that encourage the flow of radiation frequency ground current between case sections. The multipart case has a first planar groundplane section and a second planar groundplane section. For example, the multipart case design may be a slider, double slider, multiple hinge, flip, or swivel case. The second planar groundplane is substantially coplanar with the first groundplane in a case open position, and substantially bi-planar with the first groundplane in a case closed position. The wireless device also includes an antenna located adjacent the second groundplane section first end. A first and a second interface electrically connect the first groundplane section to the second groundplane section second end (the end opposite the antenna).

21 Claims, 4 Drawing Sheets

MULTIPART CASE WIRELESS COMMUNICATIONS DEVICE WITH MULTIPLE GROUNDPLANE CONNECTORS

RELATED APPLICATIONS

This application is a continuation-in-part of application Ser. No. 10/965,169, filed Oct. 13, 2004 now U.S. Pat. No. 7,012,571, and of application Ser. No. 11/215,211, filed Aug. 29, 2005, the disclosures of which are incorporated herein by reference.

FIELD OF THE INVENTION

This invention generally relates to wireless communications and, more particularly, to a wireless device with electrical interfaces between a multipart case that optimize the conduction of ground currents at antenna radiation frequencies.

BACKGROUND OF THE INVENTION

Consumers are demanding smaller and feature-rich wireless communication devices, such as cellular (cell) telephones. A smaller cell phone with more functions and features can be produced with two housing portions. One such multipart configuration is a flip phone. A flip phone opens up like a clamshell. Other configurations are sliding phones and swivel phones. In a sliding phone, one portion of the cell phone housing slides relative to the other portion. In a swivel phone, one portion of the cell phone swivels open, relative to the other portion. A sliding phone is shown in application Ser. No. 10/931,712, filed on Sep. 1, 2004, assigned to the assignee of the present application, the disclosure of which is hereby incorporated herein by reference. Generally, a wireless device case with multiple-part housing portions, including the examples described above, is referred to herein as a multipart case or multipart housing.

Typically, one arrangement of the two housing portions has an overall smaller form factor than the other arrangement. The smaller arrangement is often called the closed configuration, and the larger arrangement is called the open configuration. The cell phone user can keep the cell phone in the closed configuration when carrying the cell phone, or for storage. In use, the cell phone is put in the open configuration. Some phones can be used in both configurations.

In some configurable cell phones, both housing portions have a ground plane. Ground planes often act as the counterpoise for proximate antennas and almost always affect antenna performance. An antenna might perform optimally with the cell phone in one (i.e., open) configuration, but sub-optimally with the cell phone in the other (i.e., closed) configuration. The sub-optimal performance may be due to the positional change of one of the ground planes relative to the antenna. An antenna that depends heavily on the ground plane, such as a patch antenna, planar inverted-F antenna (PIFA), or folded monopole, may perform poorly when a grounded metal is near the antenna in some configurations.

One measure of poor antenna performance is the amount of current unintentionally generated through a transceiving device, typically as surface currents, as opposed to amount of energy radiated into the intended transmission medium (i.e., air). From the point of view of a transmitter, poor antenna performance can be measured as less radiated power, or less power in an intended direction. From the receiver perspective, poor antenna performance is associated with degraded sensitivity due to noisy grounds. From either point of view, poor performance can be associated with radio frequency (RF) ground currents.

The above-mentioned ground issues are compounded with the use of multipart type cell phone cases. Many cell phones use so-called flex films to carry signals between the two casing halves, for example, between a liquid crystal display (LCD) module and the main printed circuit board (PCB). These flex films are typically multi-layered planes of grounds and signal lines formed on, and separated by flexible sheets of dielectric insulator materials. These long thin signal wires may unintentionally act as antennas, interfering with the intended antennas and degrading the receiver performance. At the cost of connector flexibility, silver ink shielding (ground) layers can be used to cover the connector, or even added as internal layers. While this brute-force approach does shield the connector signal lines, other problems may be introduced. Since the shielded connector is located proximate to the antenna, the intended radiation patterns can be altered. Using a cell phone as an example, the shielded flex connector may cause a desired upward-pointing radiation pattern in the PCS band to point in an alternate, less desirable direction.

SUMMARY OF THE INVENTION

A multipart electrical interface design is disclosed that optimizes ground current flow being housing sections at antenna frequencies. In one embodiment, multiple interfaces between case sections is provided and the distance between the antenna and the interfaces is maximized and the frequency response of the electrical interfaces are tuned. As a result, antenna performance is optimized and receiver degradation is minimized.

Accordingly, a wireless communication device is provided with a multipart case. The multipart case has a first planar groundplane section and a second planar groundplane section. For example, the multipart case design may be a slider, double slider, multiple hinge, flip, or swivel case. The second planar groundplane is substantially coplanar with the first groundplane in a case open position, and substantially biplanar with the first groundplane in a case closed position. The wireless device also includes an antenna located adjacent the second groundplane section first end. A first and a second interface electrically connect the first groundplane section to the second groundplane section second end (the end opposite the antenna).

In one embodiment, the first interface is a one-layer (ground) conductor on a flexible dielectric and the second interface includes multiple layers of flexible dielectric with signal paths and a ground conduction path. A simple mechanical contact, such as a screw-attached spring clip, hinge, sliding rail, conductive gasket, board-to-board connectors, pogo pins, or rotating parallel plates can be used to join the first interface conductor to the first and second groundplanes, while a conventional or other connector can be used to join the second interface ground conduction path to the first and second groundplanes. Alternately, both the interfaces may include multiple layers of flexible dielectric with signal paths and a ground conduction path. By using two connecting interfaces, the electrical size of the ground plane is enlarged to increase antenna radiation efficiency, especially in the lower frequency bands.

In another aspect, an electrical interface may include a frequency-tuned groundplane medium adjacent the signal medium. The groundplane medium differentially supplies the reference (ground) voltage to the groundplane second end, responsive to the frequency of the electrical signal.

In a different aspect, the second groundplane section includes a first region for electrically connecting to the antenna, a second region for electrically connecting to the first interface, and a third region for connecting to the second interface. The second and third regions are both separated from the first region by a distance greater than 1/15 times the antenna's operating wavelength. In one variation, the second region is separated from the third region by a distance greater than 1/15 times the antenna's operating wavelength.

Additional details of the above-described wireless device interfaces, a printed circuit board (PCB), and a method for conducting ground current between sections of a multipart case are provided below.

DETAILED DESCRIPTION

Figure 1:
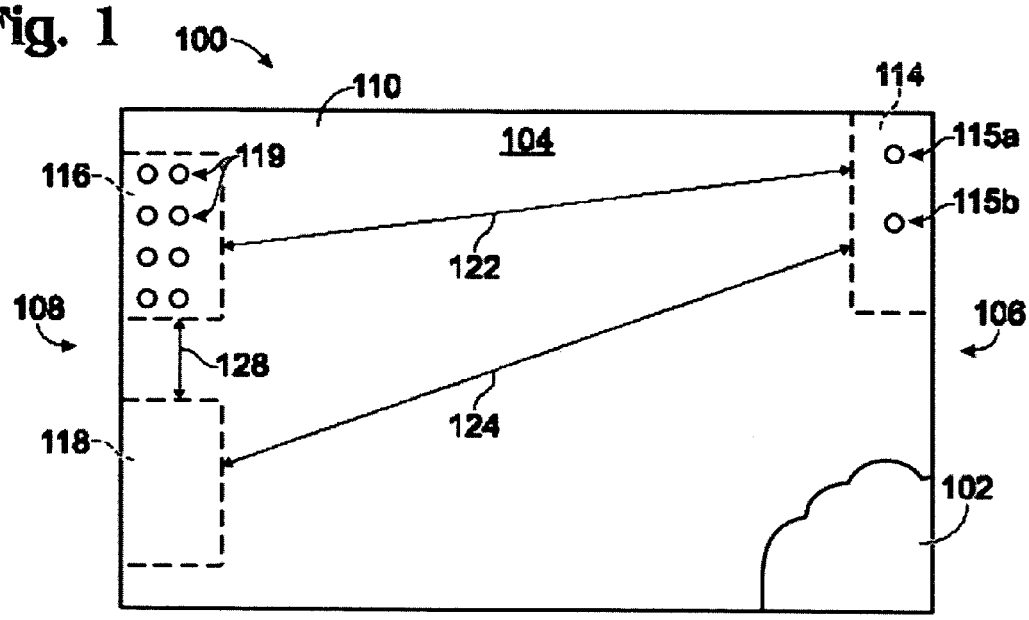
FIG. 1 is a plan view of a printed circuit board (PCB) associated with a wireless communication device with a multipart case according to an embodiment of the invention.

FIG. 1 is a plan view of a printed circuit board (PCB) associated with a wireless communication device with a multipart case according to an embodiment of the invention. The PCB 100 comprises a sheet of dielectric 102 with a planar surface 104 having a first end 106 and an opposite second end 108. Although the board is shown as having a rectangular shape for simplicity, it should be understood that the invention is not limited to any particular board shape.

Figure 2:
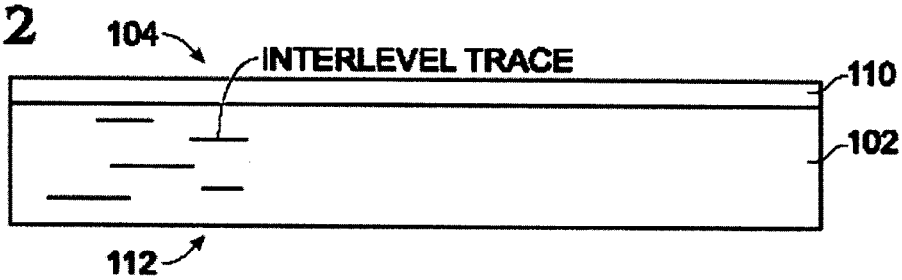
FIG. 2 is a partial cross-sectional view of the PCB of FIG. 1.

FIG. 2 is a partial cross-sectional view of the PCB 100 of FIG. 1. Viewing both FIGS. 1 and 2, a conductive groundplane layer 110 is shown overlying the dielectric surface 104. For simplicity, the groundplane layer 110 is shown as the top (surface) layer. However, it should be understood that in other aspects of the invention not shown, that the groundplane layer 110 may be an internal layer of a multilayer board, formed on the PCB bottom surface 112, or formed on multiple layers of a multilayer board. Likewise, signal traces may be formed on internal layers of the board and connected through interlevel vias.

A first region 114 overlies the dielectric first end 106, for electrically connecting an antenna (not shown). Shown are solder-plated openings 115*a* and 115*b* in the PCB 100, with connections to PCB interlevel traces (not shown), to accept signal and ground connections from an unbalanced feed antenna. Alternately but not shown, an antenna interface may be soldered to the surface of the first region 114, or plated contact holes (with connections to PCB interlevels) can be formed to accept a connector, which mates to an antenna connector interface.

A second region 116 overlies the dielectric second end 108 for connecting a first electrical interface (not shown) to another groundplane section or PCB (not shown). A third region 118 overlies the dielectric second end 108 for connecting a second electrical interface (not shown) to the other groundplane section or PCB (not shown). As shown, the second region 116 includes plated contact holes 119, with connections to PCB interlevels (not shown), to accept a connector. The third region is shown as a ground pad for mating to a simple mechanical connector, for the conduction of ground current between the PCB 100 and the second interface.

Figure 3:
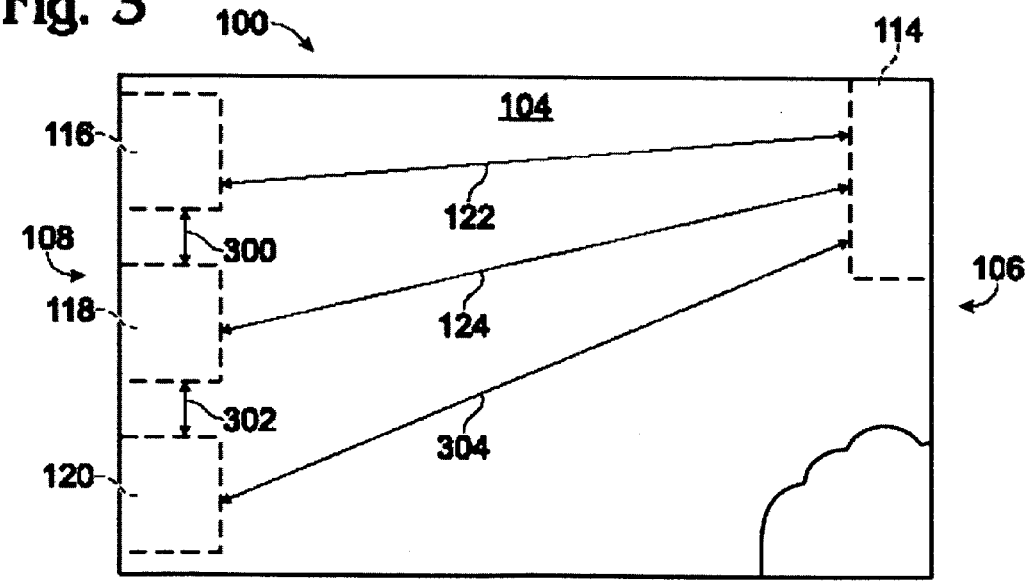
FIG. 3 is a plan view of a three-interface variation of the PCB of FIG. 1.

FIG. 3 is a plan view of a three-interface variation of the PCB of FIG. 1. In this aspect, the groundplane layer 110 further comprises a fourth region 120 overlying the dielectric second end 108 for connecting a third electrical interface to another groundplane section or PCB (not shown). Although the fourth region 120 is shown adjacent the second region 116 and third region 118, in other aspects the fourth region 120 may be formed in other areas of the PCB 100.

Referring again to FIG. 1, a typical dielectric sheet 102 has a dielectric constant in the range of about 2 to 20. The groundplane first region 114 is separated from the second region 116 by a distance 122 of greater than 1/15 of the wireless device operating wavelength. Worst case, the wavelength is measured in a free space or air medium with a dielectric constant of about 1. In some aspects, the distance 122 is more precisely measured as the distance between a groundplane connection (i.e., 115*a*) in first region 114, to a groundplane connection (i.e., 119) in second region 116. Alternately, the distance can be measured from the feed connection 115*b*. Likewise, the groundplane first region 114 is separated from the third region 118 by a distance 124 greater than 1/15 of the wireless device operating wavelength. For example, if the wireless device is a cell telephone operating in the AMPS frequency band of 824 to 894 megahertz (MHz), distance 122 or 124 is greater than about 2.3 centimeters (cm). In another aspect, the distance 128 between the second region 116 and the third region 118 is greater than 1/15 times the operating or radiating wavelength.

Returning briefly to FIG. 3, The groundplane first region 114 is separated from the second region 116 by a distance 122 of greater than 1/15 of the wireless device operating wavelength. The first region 114 is separated from the third region 118 by a distance 124 of greater than 1/15 of the wireless device operating wavelength. The first region 114 is separated from the fourth region 120 by a distance 304 of greater than 1/15 of the wireless device operating wavelength. The distance 300 between the second region 116 and the adjacent third region 118 is greater than 1/15 times the operating or radiating wavelength. The distance 302 between the third region 118 and the adjacent fourth region 120 is greater than 1/15 times the operating or radiating wavelength. Alternately stated, the closest regions are still at least 1/15 times the operating wavelength away from each other.

Figure 4A:
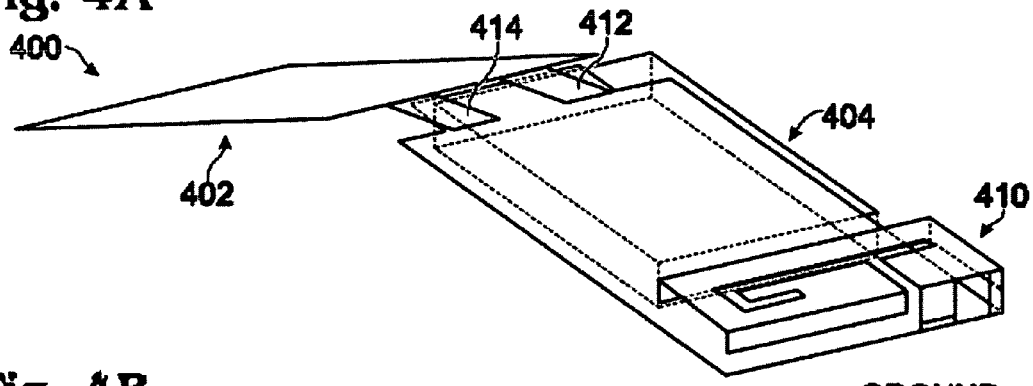
FIGS. 4A and 4B are perspective and plan views, respectively, of a wireless communication device with a multipart case according to an embodiment of the invention.
Figure 4B:
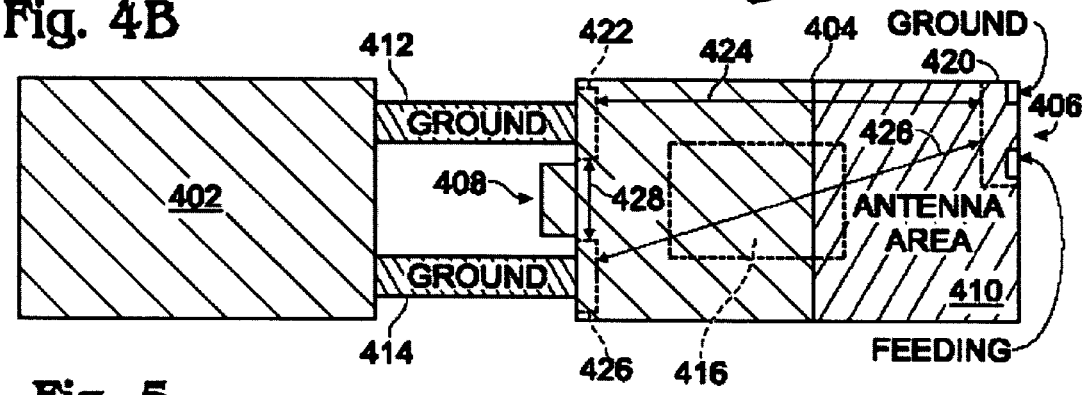

FIGS. 4A and 4B are perspective and plan views, respectively, of a wireless communication device with a multipart case. The device 400 comprises a multipart case with a first planar groundplane section 402 and associated PCB. The case also includes a second planar groundplane section 404 and associated PCB. The groundplane/PCBs depicted in FIGS. 1 through 3 are examples of the second groundplane section 404. Typically, the groundplane sections 402/404 are associated with a multilayer PCB, mounted passive and active circuitry, and interconnections between circuits. For example, the first groundplane section 402 may support circuitry associated with a liquid crystal display (not shown), while the second groundplane section 404 supports circuitry associated with wireless communication functions. The groundplanes are shown as simply overlying a PCB. However, as mentioned above, the groundplanes may alternately be internal to the PCB, in one or more layers. In other aspects, the groundplane may be formed by other means such as flex, metal cans, and plated housing or structural portions.

By locating the antenna at the opposite end of the PCB from the interfaces, the electrical size of the antenna counterpoise is maximized. The antenna counterpoise is the total effective antenna ground plane, with respect to either the antenna feed point and/or ground connection (See FIG. 1, references designators 115*a*/115*b*). The antenna location also improves receiver sensitivity, since the antenna is kept away from noisy digital lines that are carried by the interface connectors between first and second ground planes.

The second groundplane section has a first end 406 and a second end 408 opposite the first end 406. As shown, the second groundplane section 404 is substantially coplanar with the first groundplane section 402 in a case-open position. The second groundplane section 404 is substantially bi-planar with the first groundplane section 402 in a case-closed position, which is not shown. This description is intended to describe multipart case designs, such as slider, double slider, multiple hinge, flip, and swivel case designs, for example, where the positions of the first and second groundplane sections are moved with respect to each other.

An antenna 410 is located adjacent the second groundplane section first end 406. Some exemplary antennas that might be used in the wireless device include a planar inverted-F antenna (PIFA), monopole, dipole, capacitively-loaded magnetic dipole antenna, unbalanced-feed antenna, or balanced-feed antenna. A first interface 412 electrically connects the first groundplane section 402 to the second groundplane section second end 408. A second interface 414 electrically connects the first groundplane section 402 to the second groundplane section second end 408.

Figure 5:
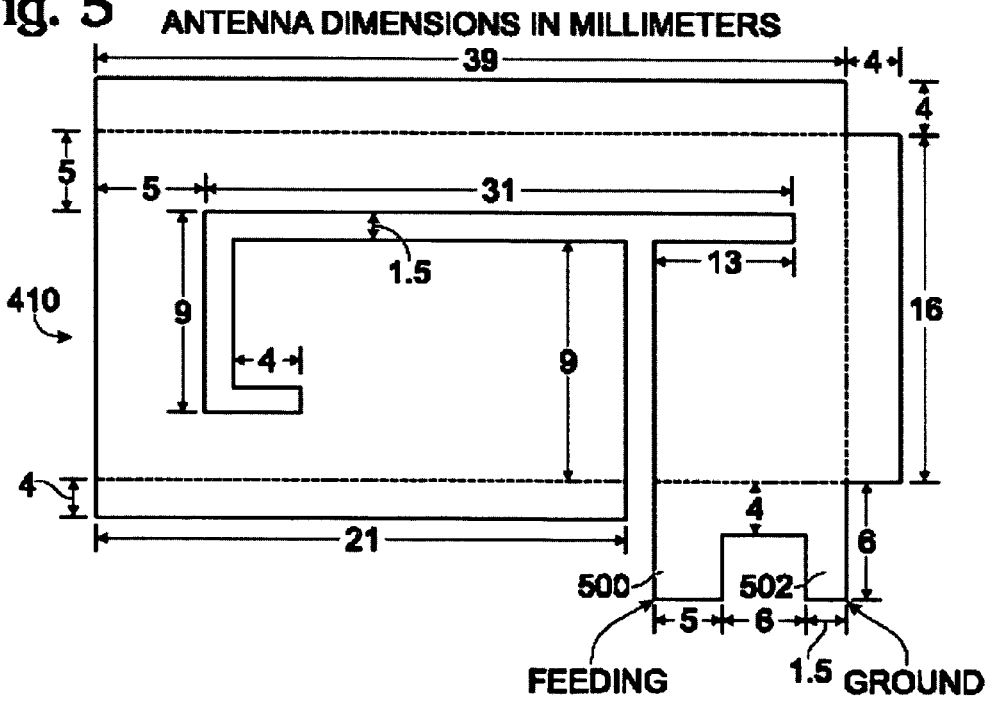
FIG. 5 is a plan view of an exemplary PIFA antenna according to an embodiment of the invention.

FIG. 5 is a plan view of an exemplary PIFA antenna. The PIFA antenna 410 is shown with dimensions in millimeters (mm). Also shown are a feed 500 for connecting antenna 410 to a PCB and ground 502 for connecting the antenna 410 to the second groundplane section.

Returning to FIG. 4B, a transceiver 416 is shown (in phantom) electrically connected to the second groundplane section 404 on the backside. The transceiver 416 communicates with the antenna 410, and may support one or more of the following wireless communication formats: code division multiple access (CDMA), cdma2000, Universal Mobile Telecommunications System (UMTS), Global System for Mobile communications (GSM), IEEE 802.11, IEEE 802.16, IEEE 802.20, WIFI, and Wimax. Alternately but not shown, the transceiver 416 may be mounted on the first groundplane section.

Figure 6:
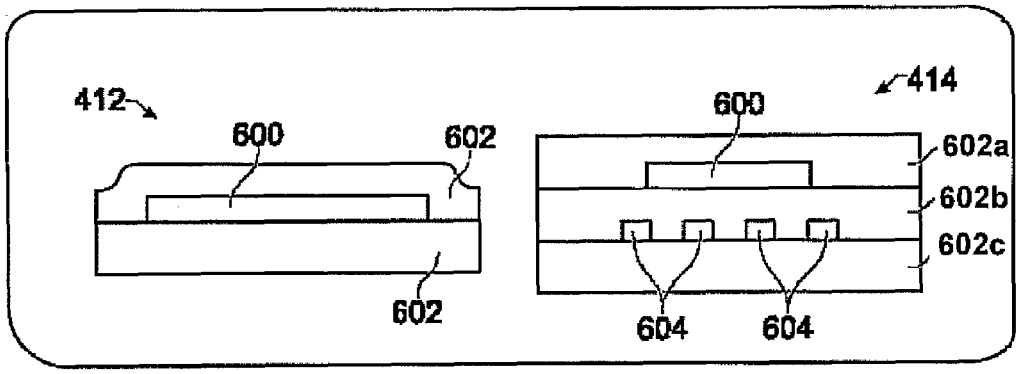
FIG. 6 is a partial cross-sectional view of the first and second interfaces according to an embodiment of the invention.

FIG. 6 is a partial cross-sectional view of the first and second interfaces. As shown, the first interface 412 is a one-layer conductor 600 on a flexible dielectric 602. In some aspects as shown, the conductor is sandwiched between layers of flexible dielectric 602. Because the interface only carries a single conductor, a mechanical contact can be used to join the conductor 600 to the first and second groundplanes (not shown).

Figure 7:
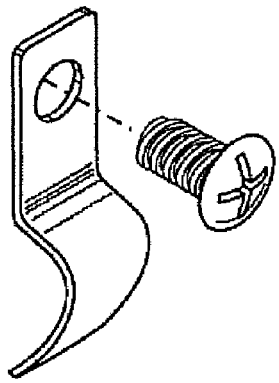
FIG. 7 is a perspective drawing of a screw-attached spring clip according to an embodiment of the invention.

FIG. 7 is a perspective drawing of a screw-attached spring clip. The spring clip assembly is one example of an electrically conductive element that can be used as a mechanical contact. Other examples or mechanical contacts (not shown) include a hinge, a sliding rail, a conductive gasket, a board-to-board connector, pogo pins, and rotating parallel plates.

Returning to FIG. 6, the second interface 414 includes multiple layers of flexible dielectric 602 with signal paths 604 and a ground conduction path 600. Shown are multiple layers of flexible dielectric 602, where one layer 602*a* supports a ground conductor 600, and one layer 602*b* supports the signal conductors 604. In one embodiment as shown, layer 602*c* covers conductor 600. However, the interface is not limited to any particular number of layers. A number of connectors, such as those known in the art, can be used to join the ground conduction path 600 to the first and second groundplanes. In another aspect, the first interface 412 is formed as the second interface 414, having multiple layers of flexible dielectric with signal paths and a ground conduction path.

The flexible dielectric material 602 may be polyester, polyimide film, synthetic polyamide polymer, phenolic, polytetrafluoroethylene (PTFE), chlorosulfonated polyethylene, silicon, ethylene propylene diene monomer (EPDM), or paper. The conductive traces 600 and 604 may be made from copper, silver, conductive ink, tin, alloys of the above-mentioned materials or any printed circuit conductor. However, the interface is not limited to any particular materials. The groundplane layers may be made from similar flexible materials and conductors.

Returning to FIG. 4B, in some aspects not shown, a third interface may be provided for electrically connecting the second groundplane section second end 404 to the first groundplane section 402, or for connecting to second groundplane section to a third groundplane section (not shown). For example, the groundplane/PCB shown in FIG. 3 is enabled to connect to a third electrical interface.

Figure 8:
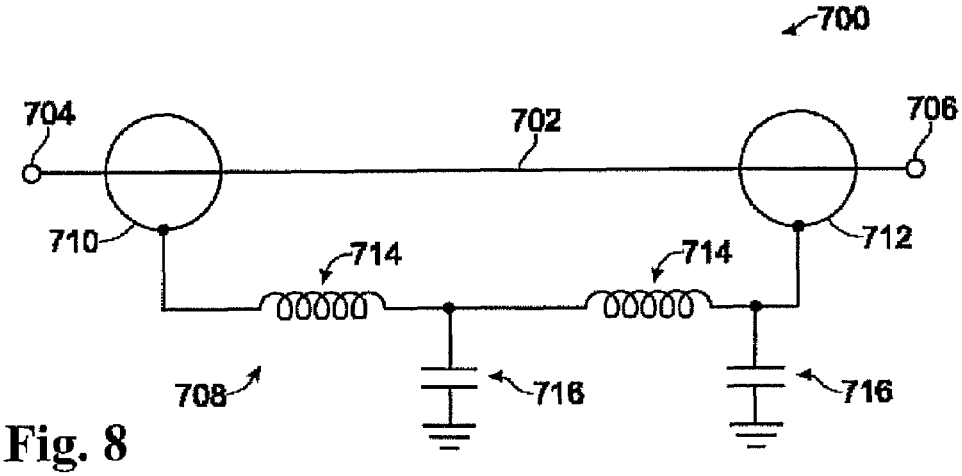
FIG. 8 is a schematic drawing of an electrical interface with a frequency-tuned groundplane according to an embodiment of the invention.

FIG. 8 is a schematic drawing of an electrical interface with a frequency-tuned groundplane. Such an interface may be used as the first interface, the second interface, or used for both the first and second interfaces. The interface 700 comprises a signal medium 702 having a first signal end 704 to accept an electrical signal and a second signal end 706 to supply the electrical signal. A groundplane medium 708 with a transmission line pattern is adjacent the signal medium 702. The groundplane medium 708 has a first groundplane end 710 to accept a reference voltage, defined with respect to the electrical signal on line 702, and a second groundplane end 712 to supply the reference voltage. The reference voltage can be signal ground, chassis ground, a dc voltage, or an ac ground. For simplicity, the reference voltage is typically referred to herein as ground.

The transmission line pattern is represented, in its simplest form, as series-connected inductive elements 714 that are shunted to ground through capacitors 716. The groundplane medium 708 may be understood to be a transmission line that differentially supplies the reference voltage to the second end 712, responsive to the frequency of the electrical signal. Alternately stated, the inductive elements 714 and capacitive elements 716 can be tuned to a maximum shunt impedance (or minimum series impedance) at an intended frequency. For example, the groundplane may be tuned to have a minimum resistance at the radiation frequency of the antenna. Other, more complex, transmission line schematic representations, such as those known in the art, are suitable for use with the present invention. The frequency-tuned groundplane can be enabled using a more complex type of transmission line.

The groundplane acts as a type of filter, creating high impedance paths for the input reference voltage at some frequencies, and low impedances at other frequencies. As can be appreciated by one of skill in the art having the benefit of the present disclosure, low pass, high pass, bandpass pass, and other filter designs can be realized by appropriately arranging the size, placement, distance between elements, inductance, and signal path of the groundplane.

Figure 9:
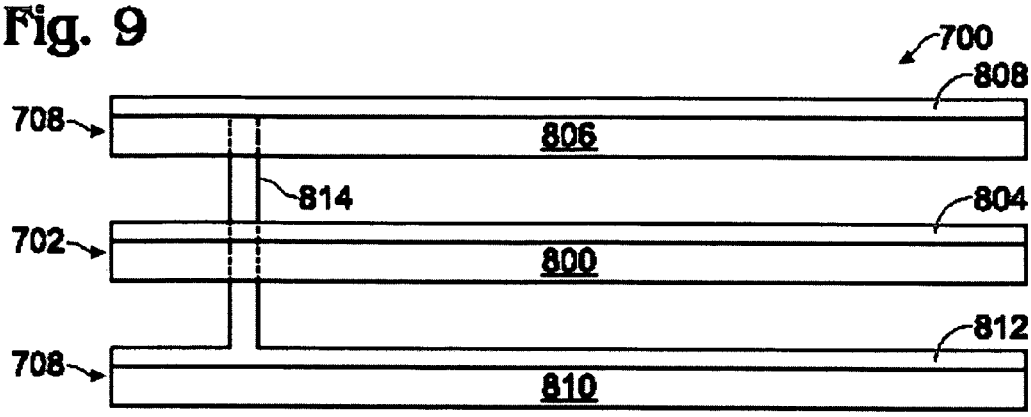
FIG. 9 is a partial cross-sectional view of an electrical interface with a frequency-tuned groundplane according to an embodiment of the invention.

FIG. 9 is a partial cross-sectional view of an electrical interface with a frequency-tuned groundplane. As in the schematic of FIG. 7, the connector 700 comprises a signal medium 702 and a frequency-tuned groundplane medium 708. For clarity, each layer is separated from adjoining layers by a space that would not exist in a completely assembled connector. In its simplest form, the signal medium 702 includes a single signal layer 800 of a flexible dielectric material with a conductive trace 804. Additional details of the above-described frequency-tuned interface are described in the parent application entitled, ELECTRICAL CONNECTOR WITH FREQUENCY-TUNED GROUNDPLANE, which is incorporated herein by reference.

Referring again to FIG. 4B, the antenna 410 has one or more operating wavelengths, or it may be tunable to different operating wavelength. A first region 420 of the second groundplane section 404 electrically connects to the antenna 410. A second region 422 electrically connects to the first interface 412, and is separated from the first region 420 by a distance 424 greater than 1/15 times the antenna's operating wavelength. The antenna's wavelength is measured with respect to an air medium with a dielectric constant of about 1. Likewise, a third region 426, for electrically connecting to the second interface 414, is separated from the first region 420 by a distance greater than 1/15 times the antenna's operating wavelength. In another aspect, the second region 422 is separated from the third region 426 by a distance 428 greater than 1/15 times the antenna's operating wavelength.

Figure 10:
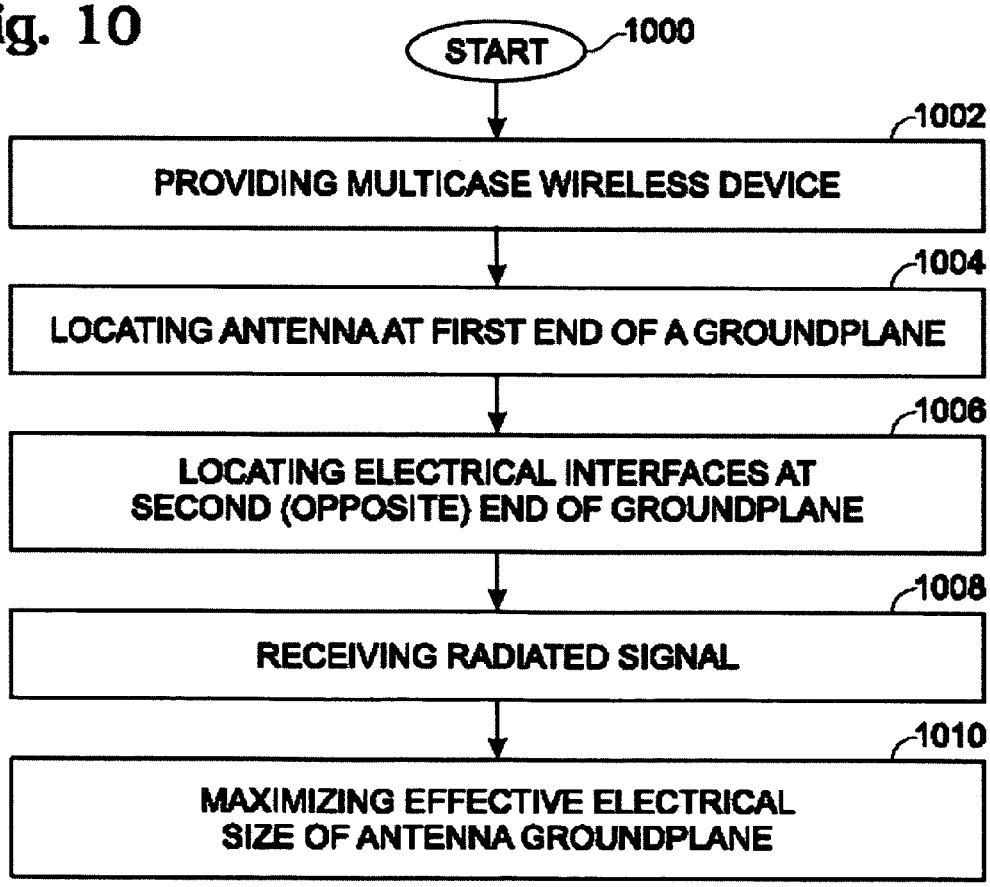
FIG. 10 is a flowchart illustrating a method for facilitating the conduction of ground current between different sections of a wireless device multipart case according to an embodiment of the invention.

FIG. 10 is a flowchart illustrating a method for facilitating the conduction of ground current between different sections of a wireless device multipart case. Although the method is depicted as a sequence of numbered steps for clarity, the numbering does not necessarily dictate the order of the steps. For example, a step may consist of one or more sub-steps or may involve specialized equipment or materials, as known in the art. It should be understood that some of these steps may be skipped, performed in parallel, or performed without the requirement of maintaining a strict order of sequence. The method starts at Step 1000.

Step 1002 provides a wireless communications device with a multipart case antenna counterpoise, including a first groundplane second and a second groundplane section. Step 1004 locates an antenna connector at a first end of the second groundplane section. Step 1006 locates a plurality of electrical interfaces to the first groundplane section, at a second end of the second groundplane section, opposite the first end. Step 1008 receives (or transmits) a radiated electromagnetic signal. Step 1010 maximizes the effective electrical size of the antenna counterpoise, in response to the plurality of electrical interfaces. Alternately expressed, the use of multiple electrical interfaces between the two groundplane sections optimizes ground current flow between the boards at the radiation frequency. This optimum current flow makes the first groundplane section more effective as an antenna counterpoise, even if the antenna is mounted and connected to the second groundplane section.

In one embodiment, locating a plurality of electrical interfaces at a second end of the second groundplane section in Step 1006 includes locating the electrical interfaces a distance from the antenna connector that is greater than 1/15 times the antenna operating wavelength. In another aspect Step 1006 locates the first electrical interface away from the second electrical interface a distance greater than 1/15 times the operating wavelength of the antenna.

A multipart case wireless communications device has been presented with electrical interfaces that optimize the flow of radiation frequency ground current between case sections. Examples of particular PCB configurations, interface designs, and interface locations have been provided to illustrate the invention. However, the invention is not limited to merely these examples. Other variations and embodiments of the invention will occur to those skilled in the art having the benefit of the present disclosure.

What is claimed is:

1. A wireless communication device with a multipart case, the device comprising:

a multipart case comprising:

a first planar groundplane section;

a second planar groundplane section having a first end and a second end opposite the first end, the second groundplane section being substantially coplanar with the first groundplane section in a case-open position of the multipart case, and substantially bi-planar with the first groundplane section in a case-closed position of the multipart case;

an antenna located adjacent the second groundplane section first end;

a first interface electrically connecting the first groundplane section to the second groundplane section second end and comprising multiple layers of flexible dielectric with signal paths and a ground conduction path, and connectors joining the ground conduction path to the first groundplane section and second groundplane section; and a second interface electrically connecting the first groundplane section to the second groundplane section second end and comprising multiple layers of flexible dielectric with signal paths and a ground conduction path, and connectors joining the ground conduction path to the first groundplane section and second groundplane section.

2. The device of claim 1 wherein the antenna is selected from the group consisting of a planar inverted-F antenna (PIFA), monopole, dipole, capacitively-loaded magnetic dipole antenna, unbalanced-feed antenna, and a balanced-feed antenna.

3. The device of claim 1 further comprising:

a third interface electrically connecting the first groundplane section to the second groundplane section second end.

4. The device of claim 1 wherein the antenna has an operating wavelength;

the second groundplane section includes a first region for electrically connecting to the antenna, a second region for electrically connecting to the first interface and separated from the first region by a distance greater than 1/15 times the antenna's operating wavelength, and a third region for electrically connecting to the second interface and separated from the first region by a distance greater than 1/15 times the antenna's operating wavelength.

5. The device of claim 1 wherein the antenna has an operating wavelength;

the second ground plane section includes a second region for electrically connecting to the first interface and a third region for electrically connecting to the second interface, separated from the second region by a distance greater than 1/15 times the antenna's operating wavelength.

6. The device of claim 1 further comprising: a transceiver having an electrical connector for connecting to the second groundplane section.

7. The device of claim 6 wherein the transceiver is a selected from the group consisting of code division multiple access (CDMA), cdma2000, Universal Mobile Telecommunications System (UMTS), Global System for Mobile communications (GSM), IEEE 802.11, IEEE 802.16, IEEE 802.20, WIFI, and Wimax.

8. The device of claim 1 wherein the flexible dielectric material is selected from the group including polyester, polyimide film, synthetic polyamide polymer, phenolic, polytetrafluoroethylene (PTFE), chlorosulfonated polyethylene, silicon, ethylene propylene diene monomer (EPDM), and paper; and wherein the first interface and the second interface comprise conductive traces made from a material selected from the group including copper, silver, conductive ink, and tin.

9. The device of claim 1 wherein the multipart case is a design selected from the group including slider, double slider, multiple hinge, flip, and swivel cases.

10. A wireless communication device with a multipart case, the device comprising:

a multipart case comprising:

a first planar groundplane section;

a second planar groundplane section having a first end and a second end opposite the first end, the second groundplane section being substantially coplanar with the first groundplane section in a case-open position of the multipart case, and substantial bi-planar with the first groundplane section in a case-closed position of the multipart case;

an antenna located adjacent the second groundplane section first end;

a first interface electrically connecting the first groundplane section to the second round lane section second end and comprising a one-layer conductor on a flexible dielectric, with mechanical contacts joining the conductor to the first groundplane section and second groundplane section; and a second interface electrically connecting the first groundplane section to the second groundplane section second end and comprising multiple layers of flexible dielectric with signal paths and a ground conduction path, and connectors joining the ground conduction path to the first groundplane section and second groundplane section.

11. The device of claim 10 further comprising:

a third interface electrically connecting the first groundplane section to the second groundplane section second end.

12. The device of claim 10 wherein the antenna has an operating wavelength;

the second groundplane section includes a first region for electrically connecting to the antenna, a second region for electrically connecting to the first interface and separated from the first region by a distance greater than 1/15 times the antenna's operating wavelength, and a third region for electrically connecting to the second interface and separated from the first region by a distance greater than 1/15 times the antenna's operating wavelength.

13. The device of claim 10 wherein the antenna has an operating wavelength;

the second groundplane section includes a second region for electrically connecting to the first interface and a third region for electrically connecting to the second interface, separated from the second region by a distance greater than 1/15 times the antenna's operating wavelength.

14. The device of claim 10 further comprising:

a transceiver having an electrical connector for connecting to the second groundplane section.

15. The device of claim 14 wherein the transceiver is a selected from the group consisting of code division multiple access (COMA), cdma2000, Universal Mobile Telecommunications System (UMTS), Global System for Mobile communications (GSM), IEEE 802.11, IEEE 802.16, IEEE 802.20, WIFI, and Wimax.

16. The device of claim 10 wherein the flexible dielectric material is selected from the group including polyester, polyimide film, synthetic polyamide polymer, phenolic, polytetrafluoroethylene (PTFE), chlorosulfonated polyethylene, silicon, ethylene propylene diene monomer (EPDM), and paper.

17. The device of claim 10 wherein the first interface and the second interface comprise conductive traces made from a material selected from the group including copper, silver, conductive ink, and tin.

18. The device of claim 10 wherein the multipart case is a design selected from the group including slider, double slider, multiple hinge, flip, and swivel cases.

19. A wireless communication device with a multipart case, the device comprising:

a multipart case comprising:

a first planar groundplane section;

a second planar groundplane section having a first end and a second end opposite the first end the second round lane section being substantially coplanar with the first groundplane section in a case-open position of the multipart case, substantially bi-planar with the first groundplane section in a case-closed position of the multipart case;

an antenna located adjacent the second groundplane section first end;

a first interface electrically connecting the first groundplane section to the second groundplane section second end and comprising a signal medium having a first signal end to accept an electrical signal and a second signal end to supply the electrical signal; and a frequency-tuned groundplane medium adjacent the signal medium having a first groundplane end to accept a reference voltage, defined with respect to the electrical signal, and a second groundplane end to supply the reference voltage, the groundplane medium differentially supplying the reference voltage to the groundplane second end, responsive to the frequency of the electrical and a second interface electrically connecting the first groundplane section to the second groundplane section second end.

20. The device of claim 19 wherein the second interface comprises:

a signal medium having a first signal end to accept an electrical signal and a second signal end to supply the electrical signal; and a frequency-tuned groundplane medium adjacent the signal medium having a first groundplane end to accept a reference voltage, defined with respect to the electrical signal, and a second groundplane end to supply the reference voltage, the groundplane medium differentially supplying the reference voltage to the groundplane second end, responsive to the frequency of the electrical signal.

21. The device of claim 19 wherein the multipart case is a design selected from the group including slider, double slider, multiple hinge, flip, and swivel cases.

* * * * *